US006457824B1

(12) United States Patent
Wexler

(10) Patent No.: US 6,457,824 B1
(45) Date of Patent: Oct. 1, 2002

(54) INK JET PRINTING METHOD

(75) Inventor: Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 40 days.

(21) Appl. No.: 09/651,845

(22) Filed: Aug. 31, 2000

(51) Int. Cl.[7] ..... B41J 2/01
(52) U.S. Cl. ..... 347/105; 428/195
(58) Field of Search ..... 347/105, 106; 428/395, 323, 327, 331, 403, 404, 407

(56) References Cited

U.S. PATENT DOCUMENTS 5,472,773 A 12/1995 Misuda et al.
5,576,088 A 11/1996 Ogawa et al.

FOREIGN PATENT DOCUMENTS

EP 0813978 A1 12/1997

*Primary Examiner*—Bruce H. Hess
*Assistant Examiner*—Michael Grendzynski

(74) *Attorney, Agent, or Firm*—Harold E. Cole

(57) ABSTRACT

An ink jet ink jet printing method, comprising the steps of:

A) providing an ink jet printer that is responsive to digital data signals;

B) loading the printer with ink jet recording elements comprising a support having thereon, in the order recited, at least one base layer comprising a hydrophilic or porous material and a porous top layer capable of either retaining or transporting an ink image, the porous top layer comprising a polymeric binder and thermally-compliant core-shell particles, the particle-to-binder ratio being between about 95:5 and 50:50, and wherein each the thermally-compliant core-shell particle has:

i) a shell of inorganic colloidal particles, and ii) a core of a thermoplastic polymer, the particles having a particle size between about 0.5 $\mu$m and about 10 $\mu$m, the polymeric core having a softening point of greater than about 50° C., and the weight ratio of the shell of the inorganic colloidal particles to the thermoplastic core being from about 1:5 to about 1:99;

C) loading the printer with an inkjet ink composition; and

D) printing on the ink jet recording element using the ink jet ink in response to the digital data signals.

12 Claims, No Drawings

INK JET PRINTING METHOD

CROSS REFERENCE TO RELATED APPLICATIONS

Reference is made to commonly assigned, co-pending U.S. patent application Ser. No. 09/482,659 by Wexler, filed concurrently herewith entitled "Ink Jet Recording Element"; the disclosure of which is hereby incorporated by reference.

FIELD OF THE INVENTION

This invention relates to an ink jet printing method, more particularly to an ink jet printing method using an ink jet recording element which contains thermally compliant composite particles having a core-shell structure.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof at least one ink-receiving layer. The ink-receiving layer is typically either a porous layer that imbibes the ink via capillary action, or a polymer layer that swells to absorb the ink. Swellable hydrophilic polymer layers take an undesirably long time to dry so that porous layers which dry more rapidly are generally regarded as superior. Ink jet recording elements may contain several layers on the support. Typical two layer constructions have either an uppermost ink transporting layer in combination with a ink retaining underlayer, or an uppermost ink image capture layer in combination with an underlying ink vehicle sump layer.

Porous layers typically contain an easily wettable but water insoluble refractory inorganic pigment as well as a binder. Typically these refractory inorganic pigment particles are comprised of either silica or alumina. The high loading of these easily wettable but refractory particles and the presence of numerous voids, which are essential to the rapid ink absorption of the layer, presents a problem in that the many interfaces presented by such a layer leads to light scattering and results in insufficient gloss. To reduce the scattering of light and thereby improve gloss, porous layers are often comprised principally of colloidal, i.e., less than 0.5$\mu$, particles. However, these particles are difficult to coat without cracking of the coated layer. Thus it is difficult to achieve high gloss with refractory particles larger than about 0.5$\mu$, and conversely it has proven difficult to coat a non-cracking layer with refractory particles smaller than about 0.5$\mu$.

U.S. Pat. No. 5,576,088 relates to an ink jet recording sheet having at least one ink-receiving layer and a gloss-providing layer consisting of a synthetic polymer latex binder and a pigment, at least 70% by weight of which is colloidal particles. The gloss-providing layer may be calendered or pressure contacted to a heated specular roll immediately after coating to further enhance the gloss. However, there are problems with this recording sheet in that the use of organic particles decreases the releasability of the gloss-providing layer from the specular roll. Further, calendering the layer prior to imaging decreases ink penetrability. In addition, the above layers have a high loading of colloidal particles so that the layers are prone to cracking due to high drying stresses.

U.S. Pat. No. 5,472,773 relates to a coated paper comprising a substrate with a surface layer of colloidal aggregates alumina crystals (or psuedo-boehmite) and a binder having a specular gloss at 60° of at least 30%. However, there are problems with this coated paper in that this gloss level is less than desirable for high quality imaged substrates and preparing the coated paper requires a costly and complex layer transfer technology.

EP 0 813 978 A1 discloses a porous ink jet recording sheet having solid fine particles in a hydrophilic binder with oil drops to reduce layer brittleness and cracking. However, there is a problem with this element in that oil drops can be exuded from the coating to give an unwanted oily surface feel and diminished gloss.

It is an object of this invention to provide an ink jet printing method using a recording element having a porous top layer that can either transport or retain an ink image, and which can be heat and pressure treated to a high gloss despite the refractory nature of incorporated inorganic pigment particles. Another object of the invention is to provide an ink jet printing method using a glossable ink jet recording element which can be coated and dried without cracking and yet maintain good ink absorptivity.

SUMMARY OF THE INVENTION

These and other objects are provided by the present invention which relates to an ink jet ink jet printing method, comprising the steps of:

A) providing an ink jet printer that is responsive to digital data signals;

B) loading the printer with ink jet recording elements comprising a support having thereon, in the order recited, at least one base layer comprising a hydrophilic or porous material and a porous top layer capable of either retaining or transporting an ink image, the porous top layer comprising a polymeric binder and thermally-compliant core-shell particles, the particle-to-binder ratio being between about 95:5 and 50:50, and wherein each the thermally-compliant core-shell particle has:

i) a shell of inorganic colloidal particles, and ii) a core of a thermoplastic polymer, the particles having a particle size between about 0.5 $\mu$m and about 10 $\mu$m, the polymeric core having a softening point of greater than about 50° C., and the weight ratio of the shell of the inorganic colloidal particles to the thermoplastic core being from about 1:5 to about 1:99;

C) loading the printer with an ink jet ink composition; and

D) printing on the ink jet recording element using the ink jet ink in response to the digital data signals.

By use of the invention, an ink jet recording element is provided which has a high gloss, does not crack and has good ink absorptivity.

DETAILED DESCRIPTION OF THE INVENTION

The composite thermally-compliant core-shell particles used in the invention may be prepared by several procedures including evaporative limited coalescence, as described in U.S. Pat. No. 4,833,060 and limited coalescence, as described in U.S. Pat. No. 5,354,799, the disclosures of which are hereby incorporated by reference. In both of these preparations, the shell is formed in-situ by a promoter during the preparation of the particle. Alternatively, the shell may be assembled via the layer-by-layer technique on preformed particles as described in "Electrostatic Self-Assembly of Silica Nanoparticle-Polyelectrolyte Multilayers of Polystyrene Latex Particles" in the Journal of the American Chemical Society, vol. 120, p. 8523 (1998).

The thermoplastic core polymer employed in the invention has a softening point greater than about 50° C., and preferably between about 50° C. and about 120° C. A softening point of a polymer can be measured by the Ring and Ball method as described in ASTM E28.

In a preferred embodiment of the invention, the thermoplastic core polymer is a polyester, an acrylic polymer or a styrenic polymer. Examples of these polymers include an amorphous polyester Kao C® (Kao Corp.), an acrylic polymer such as Carboset 526® (BF Goodrich Specialty Chemicals), or a styrene allyl alcohol copolymer such as SAA 100® (Lyondell Chemical Co.).

If the limited coalescence process is used to prepare the composite particles employed in the invention, then monomers and polymerization conditions should be chosen which will polymerize to form a core polymer with a softening point as described above. Suitable monomers include styrenic and vinyl monomers such as styrene, methylmethacrylate or butylacrylate. Mixtures of monomers, such as styrene, butylacrylate and methylmethacrylate may be polymerized to obtain the desired polymer properties.

Suitable colloidal inorganic particles which can be used as the shell material in the invention include colloidal silicas and modified colloidal silicas available from DuPont as Ludox®, and colloidal aluminas such as Dispal® (Condea Corp.). The size of the colloidal inorganic particles may range from 5 to 100 nm.

The shell of the core-shell particle used in the invention can be further modified, after formation of the primary core-shell particle, to alter a number of particle properties such as the surface charge on the particles. If the upper layer is to be ink retentive, then the surface charge on the particle should be opposite to that of the colorant. If an anionic or negative dye, for example, is the colorant, then the particle charge should be cationic or positive, so as to mordant the dye in the layer. Conversely, if the upper layer is to be ink transporting, then the surface charge on the particle should be rendered either neutral or the same as that of the dye. Surface charge on the particles can be measured via the electrokinetic sonic amplitude (ESA) technique as described in J. Colloid and Interface Science, 173,406, (1995).

As stated above, the weight ratio of the shell of the inorganic colloidal particles to the thermoplastic core is from about 1:5 to about 1:99, preferably from about 1:15 to about 1:50. The % silica is determined, on a sample washed free of unadhered colloidal silica, using 14-MeV neutron activation analysis to measure the Si content as described in "Activation Analysis with Neutron Generators" S. Nargolwalla and E. Przybylowicz eds. John Wiley & Sons, Inc. (1973), p. 528.

Also as stated above, the particle size of the core-shell particle used in the invention has a particle size between about 0.5 and about 10 $\mu$m, preferably from about 0.9 to about 5 $\mu$m. The particle size of the core-shell particle is determined by a Horiba LA-920 Laser Scattering Particle Size Distribution Analyzer (Horiba Instruments, Inc.) and is a volume-weighted mean size.

A core-shell particle having a negative surface charge, by virtue of an adherent layer of a negatively charged colloidal silica, can be rendered neutral or cationic by use of cationic surfactants as described in *Colloids and Surfaces,* 28, (1987) 159–168 and references contained therein. Water-soluble cationic polymers, such as poly(diallyl dimethylammonium) chloride or cationic colloidal latex particles, can be used to modify the surface charge of the core-shell particle as described in the above-referenced article in the Journal of the American Chemical Society. Core-shell particles having a cationic surface charge by virtue of an adherent layer of cationically charged colloidal silica, can be rendered anionic by similar procedures. Further, the surface charge and wetting properties of the silica shell can be modified by treatment with a variety of silanes as described in Chemtech,7, 766–778 (1977).

The polymeric binder useful in the recording element employed in the invention is not particularly limited. Any polymer or mixture of polymers, which are film formers and function to bind the particles described above to form a coherent layer on coating, will be useful. Examples of such binders include water soluble polymers such as gelatin, poly(vinyl alcohol), poly(ethylene oxide), poly(2-ethyl-2-oxazoline), cellulosic polymers such as methyl cellulose, emulsion polymers and copolymers such as ethylene-vinyl chloride, poly(acrylates), poly(vinylacetate), polyvinylidene chloride, vinylacetate-vinyl chloride, and aqueous polymer dispersions such as polyurethanes and polyurethane alloys.

As stated above, the particle-to-binder ratio is between about 95:5 and 50:50, preferably between about 90:10 and 80:20. If the particle-to-binder ratio is above the range stated, the layer will not have any cohesive strength. If the particle-to-binder ratio is below the range stated, the layer will not be porous enough to provide a fast dry time.

The base layer or layers, in general, will have a thickness of about 1 $\mu$m to about 50 $\mu$m, and the top layer will usually have a thickness of about 2 $\mu$m to about 50 $\mu$m.

If the uppermost layer is retentive of the ink image, then the base layer will act as a reservoir or sponge layer for the absorption of ink solvent. If the uppermost layer is ink transporting, then the base layer will additionally serve to retain the ink image. The base layer may be hydrophilic and swellable or porous. Generally, the base layer is present in an amount from about 1 g/m$^2$ to about 50 g/m$^2$, preferably from about 5.0 g/m$^2$ to about 30 g/m$^2$. Suitable hydrophilic materials include gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), polyacrylamide or mixtures thereof. Copolymers of these polymers with hydrophobic monomers may also be used. Suitable porous materials for a base layer include, for example, silica or alumina in a polymeric binder, including hydrophilic binders such as those described above.

In a preferred embodiment of the invention, the base layer comprises gelatin which may have up to about 15% of another hydrophilic material such as poly(1-vinylpyrrolidone). In another preferred embodiment, the base layer is porous fumed alumina in a crosslinked poly (vinyl alcohol) binder.

The support used in the ink jet recording element employed in the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetrafluoro ethylene), metal foil, various glass materials, and the like. In a preferred embodiment, the support is a resin-coated paper. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer or solvent-absorbing layer to the support.

Since the image recording element may come in contact with other image recording articles or the drive or transport mechanisms of image recording devices, additives such as surfactants, lubricants, matte particles and the like may be added to the element to the extent that they do not degrade the properties of interest. In addition, the top layer of the invention may also contain other additives such as viscosity modifiers or mordants.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Preparation of Core-Shell Particles of the Invention 1) 3-μm Particles with a Colloidal Silica Shell and a Polyester Core Prepared Via the Evaporative Limited Coalescence Process To 225 gm ethyl acetate was added 25 gm of Kao® C polyester resin and stirred to solution. Separately an aqueous solution was prepared of 375 gm pH 4 buffer, 21 gm Ludox TM50® colloidal silica (50 wt.% silica, DuPont Corp.), and 4.5 gm of 10% poly(adipic acid-co-methylaminoethanol). The aqueous phase was placed in a Silverson mixer and with the mixer on the organic phase was added and emulsified at 6,000 rev/min for one minute. The emulsion was then passed through a Microfluidizer (Microfluidics Manufacturing model 110T) to further reduce the emulsion droplet size. After evaporating the ethyl acetate, there was obtained a narrowly distributed population of spherical, silica coated, polyester particles $\mu$=3.0+/−0.36. Scanning electron microscopy of a freeze fractured sample showed that the surface of the particles was completely covered by a shell of adherent colloidal silica. Neutron activation analysis of a sample washed free of unadhered colloidal silica gave the weight fraction of the adhered silica shell at 3.9%. The slurry solids therefore comprised 73% core-shell particles and 27% unadhered silica. Sufficient water was decanted to give a 30% solids slurry.

2) 2-μm Particles with a Colloidal Silica Shell and a Polystyrene Core: Prepared Via the Limited Coalescence Process To 333 g styrene was added 10 g 2,2'-azobis(2,4-dimethylvaleronitrile), Vazo 52® (DuPont Corp.), and stirred until the Vazo 52® dissolved. Separately, an aqueous phase was prepared by adding to 1000 g of distilled water 10.43 g potassium hydrogen phthalate, 4 g 0.1N HCl, 7.2 g poly(adipic acid-co-methylaminoethanol) and 91.5 g of Ludox TM® colloidal silica, and stirred for 15 minutes. The organic phase was then added to the stirred (marine prop agitator) aqueous phase and stirred for 15 minutes. The resultant dispersion was passed through a Gaulin homogenizer twice at 20.7 MPa and then heated at 54 C. for sixteen hours. Neutron activation analysis of a sample washed free of unadhered colloidal silica gave the weight fraction of the adhered silica shell at 6.6%. The slurry solids therefore comprised 94% core-shell particles and 6% unadhered silica. Solids were adjusted to obtain a 27% solids slurry. There was thereby obtained a narrowly distributed population of silica coated polystyrene particles $\mu$=2.0+/−0.36 microns.

3) 6-μm Particles with a Colloidal Silica Shell and a Polyester Core Prepared Via the Evaporative Limited Coalescence Process The same procedure was used as above in 1) except that the aqueous phase had 375 g pH 4 buffer, 5.0 g Ludox TM® colloidal silica, and 1.1 g of 10% poly(adipic acid-co-methylaminoethanol). After evaporating the ethyl acetate, there was obtained a narrowly distributed population of silica coated polyester particles $\mu$=6.4+/−0.36. Neutron activation analysis of a sample washed free of unadhered colloidal silica gave the weight fraction of the adhered silica shell at 2.1%. The slurry solids therefore comprised 93% core-shell particles and 7% unadhered silica. Sufficient water was decanted to give a slurry with 30% solids.

4) 2-μm Particles with a Colloidal Silica Shell and a Polystyrene Core: Prepared Via the Limited Coalescence Process and Surface Charge Modified with a Colloidal Cationic Latex To 15.1 g of the 27% solids slurry prepared as above in 2) was added 1.7 g of a 15% solids cationic 100 nm colloidal latex dispersion of divinylbenzene-co-N-vinylbenzyl-N,N,N-trimethylammonium chloride. ESA titration gave an equivalence point of 0.033 g 15% latex per gram solids.

5) 2-μm Particles with a Colloidal Silica Shell and a Polystyrene Core: Prepared Via the Limited Coalescence Process and Surface Charge Modified with a Cationic Water-Soluble Polymer To 15.1 g of the 27% solids slurry prepared as above in 2) was added 1.7 g of a 0.2% aqueous solution of poly(diallyl dimethylammonium chloride) (Aldrich Corp.). ESA titration gave an equivalence point of 0.05 g 0.2% polymer per gram solids.

6) 2-μm Particles with a Colloidal Silica Shell and a Polystyrene Core: Prepared Via the Limited Coalescence Process and Surface Modified by a Silane To 20 g of the 27% solids slurry prepared as above in 2) was added 0.27 g of N-(2-aminoethyl)-3-aminopropylmethyl-dimethoxysilane (United Chemical Technologies, Inc.) and the mixture stirred overnight.

C-1 Control Colloidal Silica Particles

Commercial Ludox TM50®, a 50% dispersion of 22 nm silica particles was used.

C-2 Control 1 μm Silica Gel Particles

Commercial SyloJet® 710A a 20% solids slurry of 1 μm silica gel particles was used.

C-3 Control 6 μm Silica Gel Particles

Commercial Gasil® 23 6 μm, silica (Crossfield Limited) was added to sufficient water to give an 18% solids slurry.

Solution 1 of the Invention:

To 9.0 g of the 30% solids slurry 1 was added 9.63 g of water and 1.37 g of Witcobond® W215 polyurethane (Witco Corp.) to give a 16% solids slurry having a solids ratio of 80 parts 3 μm core-shell particles to 20 parts polyurethane binder.

Solution 2 of the Invention

To 18.2 g of the 27% solids slurry 2 was added 0.1 g of water and 1.72 g of Airflex® 4500 ethylene-vinyl chloride emulsion (Air Products Corp) emulsion to give a 30% solids slurry having a solids ratio of 84 parts 2 μm core-shell particles to 16 parts binder.

Solution 3 of the Invention

To 10.0 g of the 27% solids slurry 2 was added 1.37 g of Witcobond® W320 polyurethane (Witco Corp.) to give a 28% solids slurry having a solids ratio of 84 parts 2 μm core-shell particles to 16 parts binder.

Solution 4 of the Invention

To 17.4 g of deionized water is added, 12 g of the 30% solids slurry 3, 20.2 g of a 10% poly(vinyl alcohol) solution (Gohsenol® Z200 Nippon Gohsei Corp.), 8.6 g of a 10% gelatin solution, 1.55 g of a latex polymer, Rhoplex® B-60A, (Rohm and Haas Co.) and 0.3 g of a 10% surfactant solution (Olin 10G®) to give a 12% solids slurry having a solids ratio of 48 parts 6 μm core-shell particles to 52 parts binder.

Solution 5 of the Invention

To the aqueous slurry of surface charge modified particles 4) of the invention, was added 2.19 g of Witcobond®215 polyurethane to give a 27% solids slurry.

Solution 6 of the Invention

To the aqueous slurry of surface charge modified particles 5) of the invention, was added 2.19 g of Witcobond®215 polyurethane to give a 27% solids slurry.

Solution 7 of the Invention

To 20.3 g of the aqueous slurry of the silane modified particles 6) of the invention was added an additional 7.9 g of deionized water. Separately 10 g of deionized water was added to 2.74 g of Witcobond®215 polyurethane and this mixture was then added to the stirred particles to give a 16% slurry.

Control Solution C-1

To 9.81 g deionized water was added 2.5 g 1% potassium hydrogen phthalate, 0.8 g 0.01N HCl, 5.22 g of C-1, Ludox TM50 ® colloidal silica, and 1.1 g of 10% poly(adipic acid-co-methylaminoethanol). To this stirred suspension was then added 1.37 g polyurethane, Witcobond®215, to give a 16% solids slurry having a solids ratio of 85 parts 22 nm colloidal silica particles to 15 parts polyurethane binder.

Control Solution C-2

To 9.41 g deionized water was added 2.5 g 1% potassium hydrogen phthalate, 0.8 g 0.01N HCl, 3.89 g of C-1, Ludox TM50 ® colloidal silica, and 0.83 g of 10% poly(adipic acid-co-methylaminoethanol). To this stirred suspension was then added 3.37 g polyurethane, Witcobond®215 to give a 16% solids slurry having a solids ratio of 63 parts 22 nm colloidal silica particles to 37 parts polyurethane binder.

Control Solution C-3

To 11.4 g of deionized water was added 18 g of the 20% solids slurry of control particles C-2, 1.55 g of a latex polymer, Rhoplex® B-60A, (Rohm and Haas Co), 20.2 g of a 10% poly(vinyl alcohol) solution, Gohsenol Z200®, 8.6 g of a 10% gelatin solution and 0.3 g of a 10% surfactant solution (Olin 10G®) to give a 12% solids slurry having a solids ratio of 50 parts 1 μm silica gel particles to 50 parts binder.

Control Solution C-4

To 18.75 g of deionized water is added, 40.0 g of the 18% solids slurry of control particles C-3, 40.4 g of a 10% poly(vinyl alcohol) solution, Gohsenol Z200®, 17.2 g of a 10% gelatin solution, 3.10 g of a latex polymer, Rhoplex® B-60A, and 0.6 g of a 10% surfactant solution (Olin 10G®) to give a 12% solids slurry having a solids ratio of 50 parts 6 μm silica gel particles to 50 parts binder.

Preparation of Base Layers

A polyethylene resin-coated paper support was corona discharge treated. The support was then coated at 40° C. with either:

a) an aqueous solution comprising 6.7% gelatin, and 1.2% poly(vinyl pyrrolidone), K90 (International Specialty Products Co.) to provide a base layer of 8.6 g/m$^2$;

b) an aqueous solution comprising 3.0% gelatin, 0.60% poly(vinyl pyrrolidone), K90 (International Specialty Products Co.) and 0.40% cationic 100 nm colloidal latex dispersion of divinylbenzene-co-N-vinylbenzyl-N,N,N-trimethylammonium chloride to provide a base layer of 4.3 g/m$^2$; or c) a first 38 μm underlayer comprising 87% fumed alumina, 9% poly(vinyl alcohol), and 4% dihydroxydioxane crosslinking agent, and on the first underlayer a second 2 μm layer comprising 87% fumed alumina, 8% 100 nm colloidal latex dispersion of divinylbenzene-co-N-vinylbenzyl-N,N,N-trimethylammonium chloride, 6% poly(vinyl alcohol), and 1% Zonyl ®FSN surfactant (Dupont Corp.).

The solutions were coated over the underlayers using a wire wound rod, calibrated to give a wet laydown of 120 μm and air dried to form Elements 1– 8 of the Invention and Control Elements 1–3. The 60° gloss was then measured using a micro-TRI-gloss reflectometer (BYK Gardener Corp.).

Fusing

The coatings were fused in a heated nip at 150° C. and 4.2 kg/cm$^2$ either against:

a) A 75 μm polyimide film sheet Kapton® (DuPont) at 45.7 cm/min or, b) A sol-gel coated polyimide Kapton® (DuPont) belt at 63.5 cm/min.

After cooling to room temperature, the fused composite was separated and the 60° gloss was measured again. The following results were obtained:

TABLE 1

| Element | Particle | Coating Solution | Base Layer | Fusing | Gloss Before | Gloss After |
|---|---|---|---|---|---|---|
| 1 | 3 μm Core-Shell | 1 | a | a | 2.5 | 87.9 |
| 1 | 3 μm Core-Shell | 1 | a | b | 2.4 | 96.5 |
| 2 | 2 μm Core-Shell | 2 | a | a | 2.6 | 91.4 |
| 3 | 2 μm Core-Shell | 3 | c | b | 2.4 | 89.7 |
| 4 | 6 μm Core-Shell | 4 | b | a | 3 | 67.4 |
| 5 | 2 μm Core-Shell | 5 | a | b | 2.4 | 81.4 |
| 6 | 2 μm Core-Shell | 5 | b | b | 2.4 | 82.4 |

TABLE 1-continued

| Element | Particle | Coating Solution | Base Layer | Fusing | Gloss Before | Gloss After |
|---|---|---|---|---|---|---|
| 7 | 2 μm Core-Shell | 6 | a | a | 2.4 | 64.2 |
| 8 | 2 μm Core-Shell | 7 | a | a | 2.6 | 68.9 |
| C-1 | 22 nm silica | C1 | a | a | 6.3 | 9.1 |
| C-2 | 22 nm silica | C2 | a | a | 3.2 | 11.9 |
| C-3 | 1 μm silica gel | C3 | b | b | 2.6 | 3.0 |
| C-4 | 6 μm silica gel | C4 | b | a | 2.4 | 2.7 |
| C-4 | 6 μm silica gel | C4 | b | b | 2.4 | 2.8 |

The above results show that the elements employed in the on provided high gloss as compared to the control elements.

Example 2

Layer Cracking and Ink Receptivity

The elements were imaged with a Hewlett-Packard Photosmart® with a 9 mm by 8 mm rectangular test patch for each of the primary and ary colors at 100% ink coverage. The printed elements were then examined Absorptivity in accordance with the following evaluation standards.

A: No deformation of the rectangular pattern with sharp edges of the pattern maintained.

B: The rectangular pattern was slightly rounded with smooth edges

C: Major spreading and deformation of the rectangular pattern with ragged edges

D. Puddling of the ink on the surface

For good ink absorptivity an evaluation of A or B is necessary.

Layer Integrity was evaluated on the above printed elements in both the printed and unprinted regions by observing the layer surface with an eight power magnifying lens according to the following criteria:

A: No cracks observed

B: Some cracks observed, but no practical problem in image quality.

C: Cracks observed, and problem in image quality, but no cracks observed unaided visually.

D: Cracks observed unaided visually, and serious problems in image quality.

For good Layer Integrity an evaluation of A or B is necessary. The following results were obtained:

TABLE 2

| Element | Particle | Binder (%) | Layer Integrity | Ink Absorptivity |
|---|---|---|---|---|
| 1 | 3 μm core-shell | 15 | A | A |
| 2 | 2 μm core-shell | 15 | A | A |
| C-1 | 5 nm silica | 15 | D | A |
| C-2 | 5 nm silica | 37 | A | D |

The above results show that the elements employed in the invention had good layer integrity and ink absorptivity relative to the controls. Specifically, no cracking was found for Elements 1 and 2, which have the same weight fraction binder as Control element C-1, which cracks severely. Control element C-2, with a higher weight fraction binder, did not crack but had very poor ink receptivity.

This invention has been described with particular reference to preferred embodiments thereof but it will be understood that modifications can be made within the spirit and scope of the invention.

What is claimed is:

1. An inkjet ink jet printing method, comprising the steps of:

A) providing an ink jet printer that is responsive to digital data signals;

B) loading said printer with ink jet recording elements comprising a support having thereon, in the order recited, at least one base layer comprising a hydrophilic or porous material and a porous top layer capable of either retaining or transporting an ink image, said porous top layer comprising a polymeric binder and thermally-compliant core-shell particles, the particle-to-binder ratio being between about 95:5 and 50:50, and wherein each said thermally-compliant core-shell particle has:

i) a shell of inorganic colloidal particles, and ii) a core of a thermoplastic polymer, said particles having a particle size between about 0.5 μm and about 10 μm, said polymeric core having a softening point of greater than about 50° C., and the weight ratio of the shell of said inorganic colloidal particles to said thermoplastic core being from about 1:5 to about 1:99;

C) loading said printer with an ink jet ink composition; and

D) printing on said ink jet recording element using said ink jet ink in response to said digital data signals.

2. The method of claim 1 wherein said base layer comprises gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly (acrylic acid), poly(1-vinylpyrrolidone), poly(sodium styrene sulfonate), poly(2-acrylamido-2-methane sulfonic acid), polyacrylamide, silica, alumina, or mixtures thereof.

3. The method of claim 1 wherein said base layer comprises a mixture of gelatin and poly(vinyl pyrrolidone).

4. The method of claim 1 wherein said base layer comprises a mixture of fumed alumina and crosslinked poly (vinyl alcohol).

5. The method of claim 1 wherein said base layer has a thickness of about 1 μm to about 20 μm and said top layer has a thickness of about 2 μm to about 50 μm.

6. The method of claim 1 wherein said support is resin-coated paper.

7. The method of claim 1 wherein said polymeric binder is gelatin, poly(vinyl alcohol), poly(ethylene oxide), poly (2-ethyl-2-oxazoline), methyl cellulose, an ethylene-vinyl chloride copolymer, a polyacrylate, poly(vinyl acetate), poly (vinylidene chloride), a vinyl acetate-vinyl chloride copolymer or a polyurethane.

8. The method of claim 1 wherein said polymeric binder comprises a polyurethane.

9. The method of claim 1 wherein said thermoplastic polymer is a polyester, an acrylic polymer or a styrenic polymer.

10. The method of claim 1 wherein said inorganic colloidal particles are colloidal silica or colloidal alumina.

11. The method of claim 10 wherein the surface of said colloidal silica or colloidal alumina is positively charged.

12. The method of claim 10 wherein the surface of said colloidal silica or colloidal alumina is negatively charged.

* * * * *